US009341323B1

(12) United States Patent
Wang et al.

(10) Patent No.: US 9,341,323 B1
(45) Date of Patent: May 17, 2016

(54) LIGHT-MIXING FLASHLIGHT

(71) Applicant: National Chung Cheng University, Minhsiung Township (TW)

(72) Inventors: Hsiang-Chen Wang, Minhsiung Township (TW); Chung-Yi Lin, Minhsiung Township (TW); Yuan-De Su, Minhsiung Township (TW); Zhi-Lin Hu, Minhsiung Township (TW)

(73) Assignee: National Chung Cheng University, Minhsiung Township ( * ) Notice: Subject to any disclaimer, the term of this patent is extended or adjusted under 35 U.S.C. 154(b) by 0 days.

(21) Appl. No.: 14/658,515

(22) Filed: Mar. 16, 2015

(51) Int. Cl.

| | |
|---|---|
| ***F21L 4/02*** | (2006.01) |
| ***F21V 33/00*** | (2006.01) |
| ***F21K 99/00*** | (2016.01) |
| *F21Y 101/02* | (2006.01) |

(52) U.S. Cl.
CPC . *F21K 9/54* (2013.01); *F21L 4/027* (2013.01); *F21Y 2101/02* (2013.01)

(58) Field of Classification Search
CPC ..... F21K 9/54; F21L 4/027; F21Y 2101/02
USPC ..... 362/184, 197, 202
See application file for complete search history.

(56) References Cited

U.S. PATENT DOCUMENTS

2010/0046211 A1* 2/2010 Spartano ..... F21L 4/027 362/157

* cited by examiner

*Primary Examiner* — Elmito Breval
*Assistant Examiner* — Glenn Zimmerman
(74) *Attorney, Agent, or Firm* — Tracy M Heims; Apex Juris, Pllc.

(57) ABSTRACT

A light-mixing flashlight has a body, three light-emitting diodes, three first reflectors, and three second reflectors. The body has a mounting surface formed in the body, a body opening opposite to the mounting surface, and three light recesses formed in an interior of the body. The light-emitting diodes are mounted in the light recesses, and are respectively a red light, a green light, and a blue light light-emitting diode. The first reflectors are formed as parabolic mirrors and are respectively mounted in the light recesses via a working angle. An opening of each first reflector faces toward the corresponding light-emitting diode. The second reflectors are formed as spherical mirrors, are mounted on the mounting surface, and respectively correspond in position to the first reflectors. Therefore, the light-mixing flashlight has an improved emitting efficiency.

12 Claims, 6 Drawing Sheets

LIGHT-MIXING FLASHLIGHT

BACKGROUND OF THE INVENTION

1. Field of the Invention

The present invention relates to a flashlight, and more particularly to a light-mixing flashlight.

2. Description of Related Art

Generally, enteroviruses usually attack children. In an early stage of enterovirus infection, sore throat or foot and mouth disease may occur in a child patient, so a pediatrician confirms diagnosis of the enterovirus infection according to an inflammatory condition in the mouth. During the diagnosis process, a fluorescent is applied as a light source. The pediatrician uses the fluorescent to observe the mouth of the patient to identify locations of disease.

Though the fluorescent has a wide spectrum and a fine color rendering, a color contrast of the fluorescent is insufficient, such that degree of visual recognition on the mouth of the patient is insufficient. In order to increase the color contrast, a red light, a green light and a blue light are mixed to form a white light as an identifying light. Three light-emitting diodes are mounted in a flashlight to provide the white light. A spectrum of light-emitting diode is relatively narrow, such that a color contrast of the light-emitting diode can be increased relative to the fluorescent. Therefore, the pediatrician can use the white light to identify the locations of disease easily.

A conventional flashlight comprises light guiding tubes and diffusion sheets assembled as a diffusion device to guide and mix the light. However, though the diffusion device can assist with light mixing, an emitting efficiency of the light after the light passes through the diffusion device is decreased. Therefore, how to achieve a fine mixing effect for the light without affecting the emitting efficiency needs to be resolved.

SUMMARY OF THE INVENTION

The main objective of the present invention is to provide an improved light-mixing flashlight to resolve the afore-mentioned problems.

The light-mixing flashlight comprises a body, three light-emitting diodes, three first reflectors, and three second reflectors.

The body is elongated and hollow, and comprises a longitudinal direction, a mounting surface formed on a bottom of an interior of the body, and a body opening formed through an end of the body and located at a position opposite to the mounting surface. The body further comprises three light recesses formed in the interior of the body at intervals.

The light-emitting diodes are respectively mounted in the light recesses. The light-emitting diodes are respectively a red light-emitting diode, a green light-emitting diode, and a blue light-emitting diode. Each light-emitting diode is mounted in the corresponding light recess at a working angle.

The first reflectors are respectively mounted in the light recesses and are formed as parabolic mirrors. Each first reflector is rotated 19 degrees relative to the longitudinal direction of the body and comprises a radius of curvature being 40 millimeters and an opening having a width of 16 millimeters and facing toward the mounting surface of the body. Each first reflector further comprises a vertex distal from the corresponding light-emitting diode by 20 millimeters. The working angle of each light-emitting diode is defined by first rotating each light-emitting diode 30 degrees relative to the longitudinal direction of the body and then 19 degrees relative to the vertex of the corresponding first reflector.

The second reflectors are formed as spherical mirrors, are mounted on the mounting surface, and respectively correspond to the first reflectors. Each second reflector is rotated 8.17 degrees relative to the longitudinal direction of the body and comprises a radius of curvature being 105 millimeters and a center being distal from the vertex of the corresponding first reflector by 63.5 millimeters and being distal from a center of the mounting surface by 15.3 millimeters.

Other objectives, advantages and novel features of the present invention will become more apparent from the following detailed description when taken in conjunction with the accompanying drawings.

DETAILED DESCRIPTION OF PREFERRED EMBODIMENT

Figure 1:
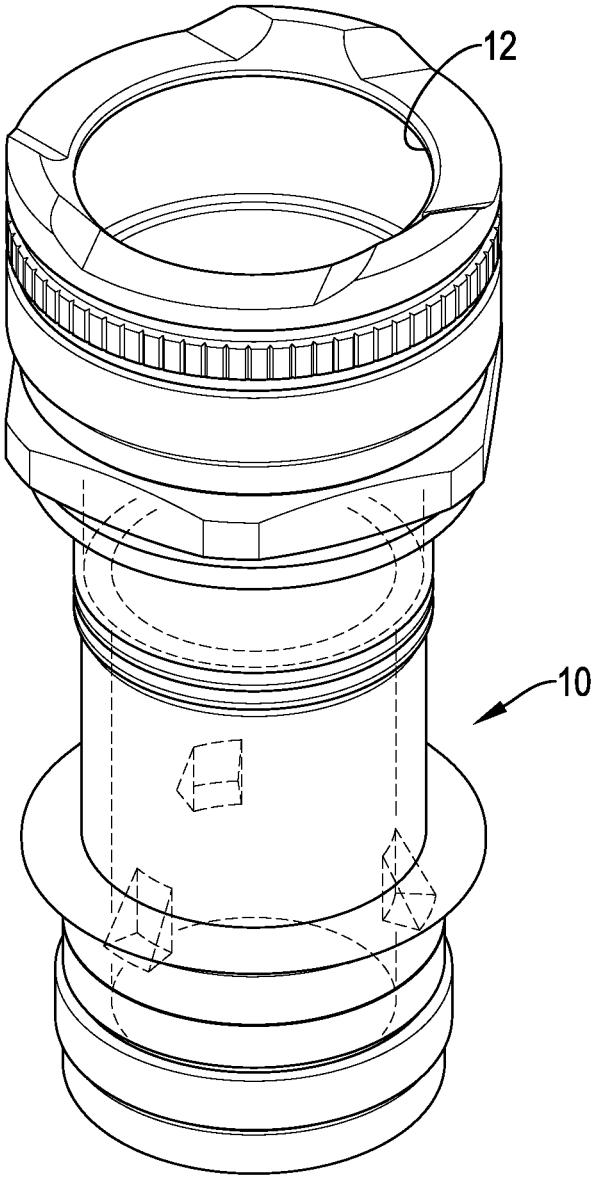
FIG. 1 is a perspective view of a preferred embodiment of a light-mixing flashlight in accordance with the present invention.
Figure 2:
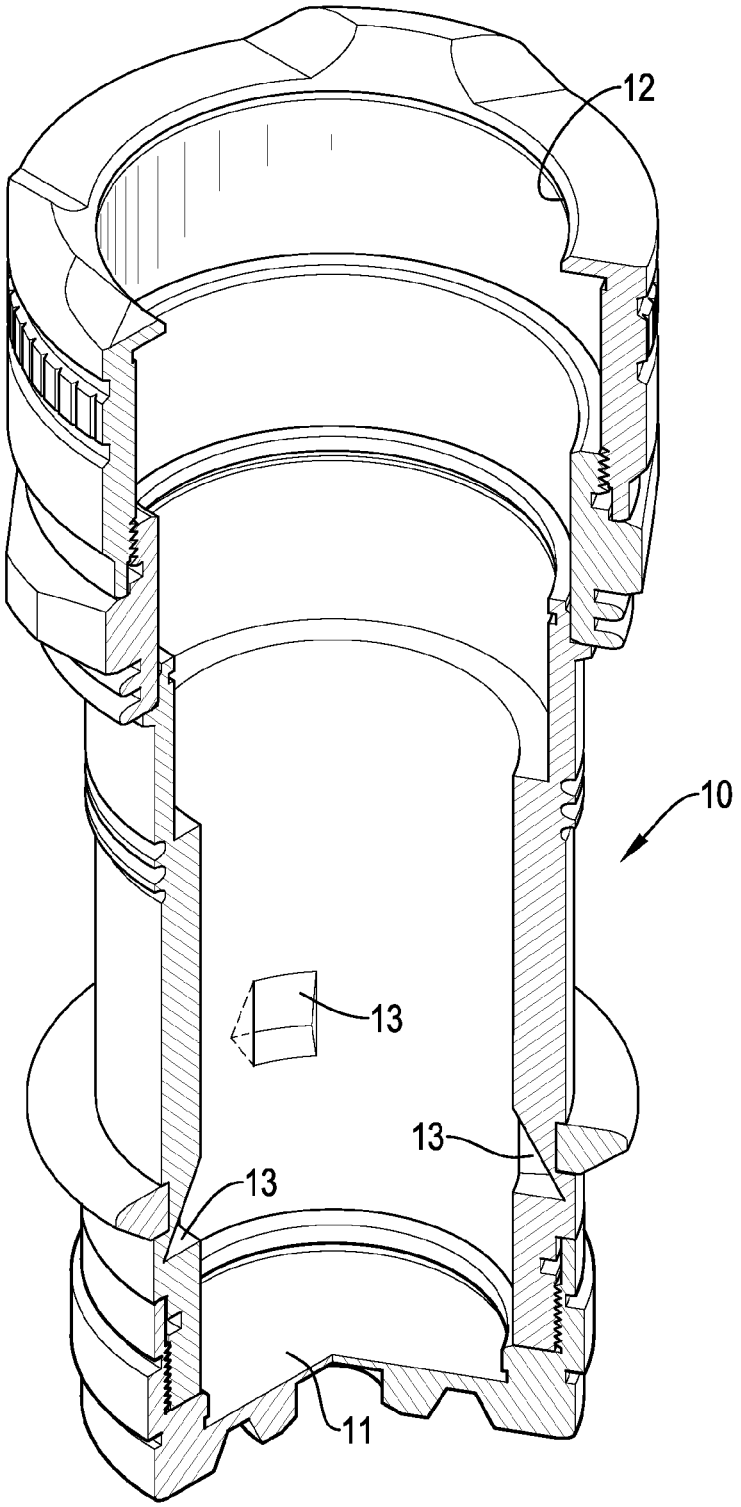
FIG. 2 is a cross sectional perspective view of the light-mixing flashlight in FIG. 1.
Figure 3:
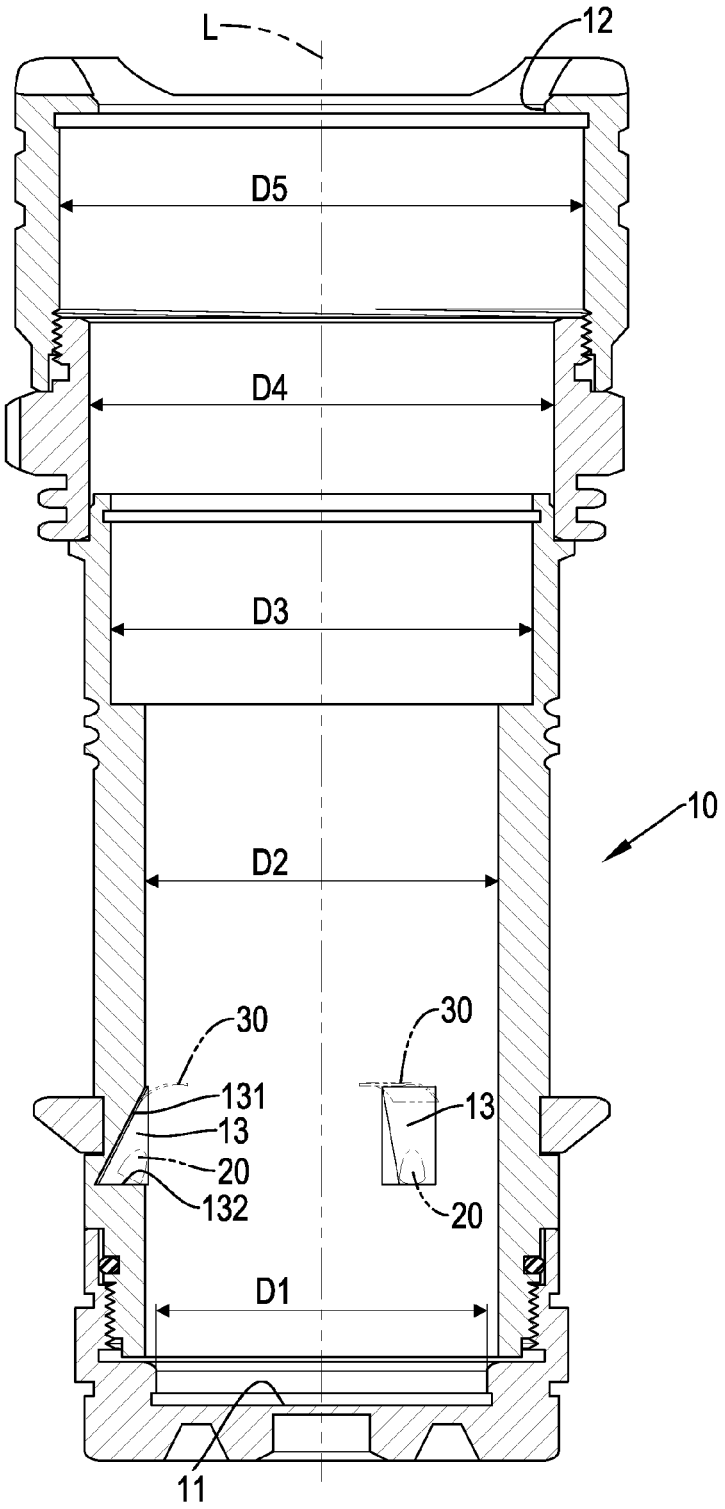
FIG. 3 is a cross sectional side view of the light-mixing flashlight in FIG. 1.
Figure 4:
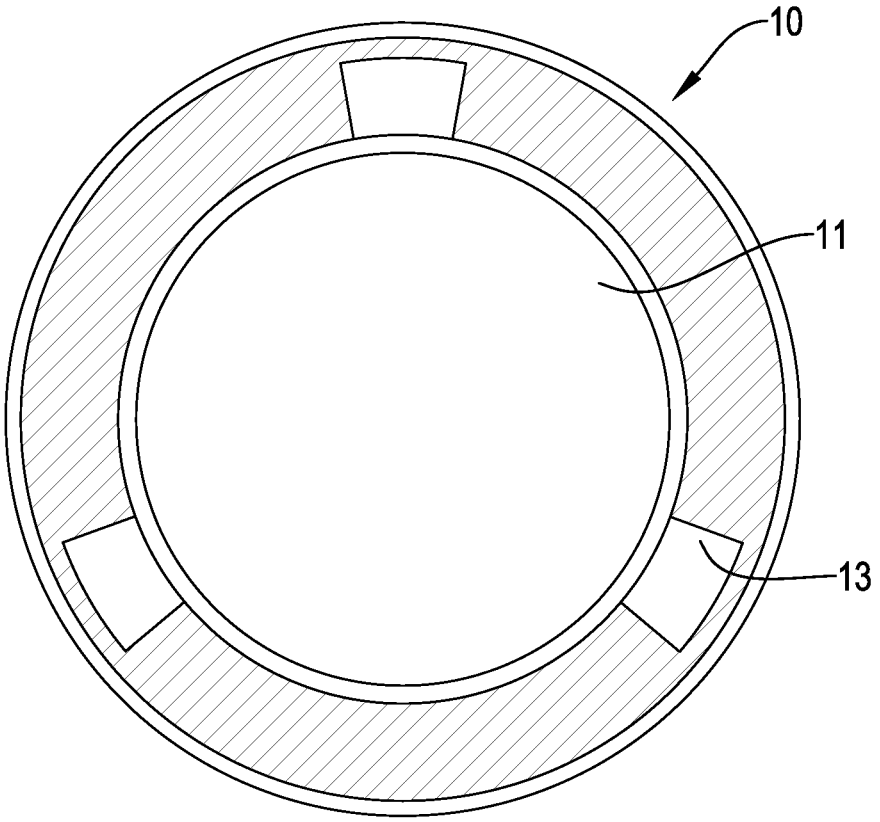
FIG. 4 is a cross sectional top view of the light-mixing flashlight in FIG. 1.
Figure 6:
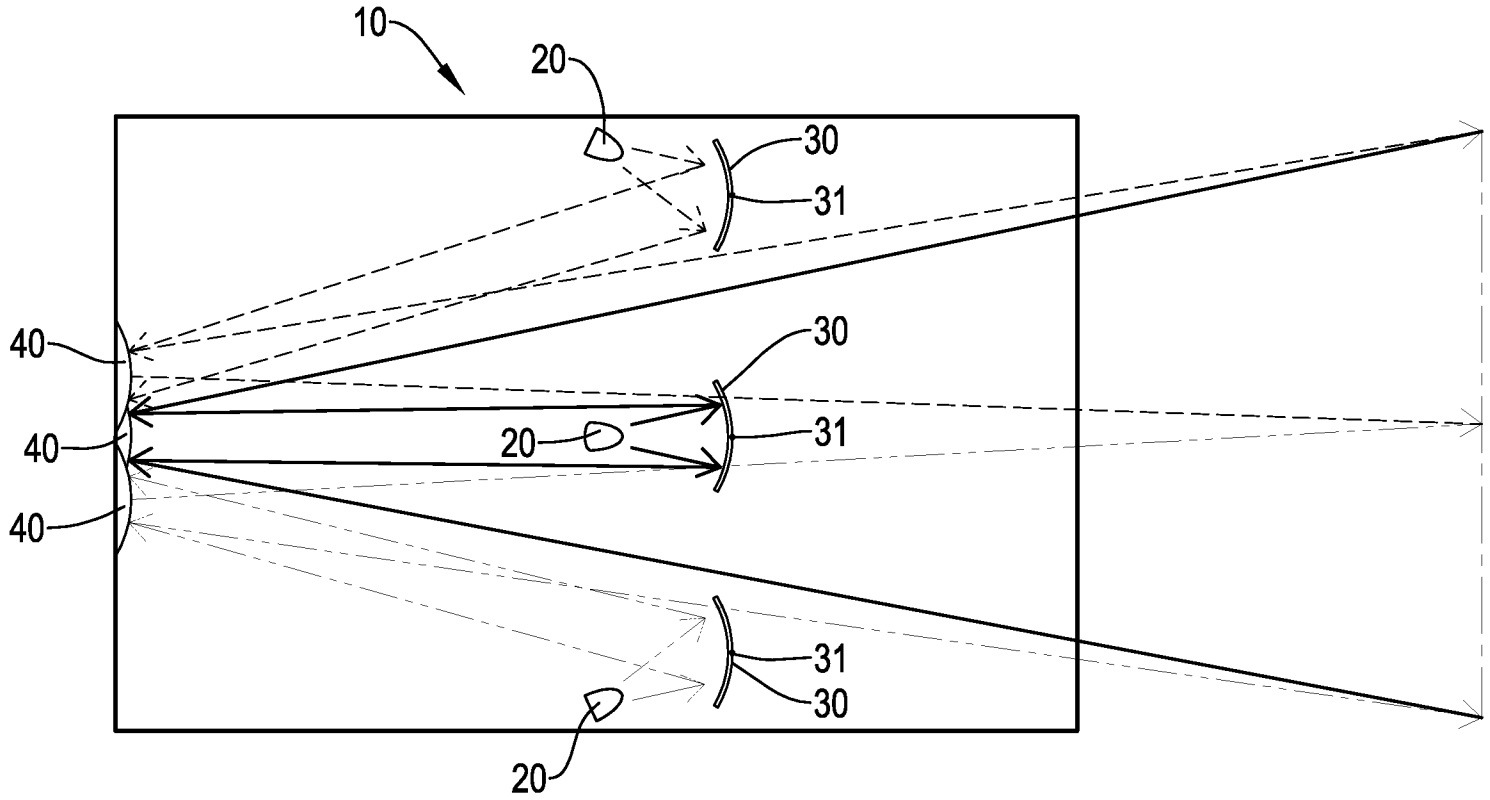

With reference to FIGS. 1 to 4, and 6, a preferred embodiment of a light-mixing flashlight in accordance with the present invention comprises a body 10, three light-emitting diodes 20, three first reflectors 30, and three second reflectors 40.

The body 10 is elongated and hollow. An interior of the body 10 is made of aluminum having a relatively high reflectivity, such that during a reflection process of light, energy loss of the light can be decreased. The body 10 comprises a longitudinal direction L, a mounting surface 11, a body opening 12, and three light recesses 13. The mounting surface 11 is formed on a bottom of the interior of the body 10. The body opening 12 is formed through an end of the body 10 and located at a position opposite to the mounting surface 11. The light recesses 13 are formed in the interior of the body 10 at intervals. Preferably, a longitudinal length of the body along the longitudinal direction L is 230 millimeters. Inner diameters D1 to D5 of the body 10 sequentially are 75 millimeters, 80 millimeters, 96 millimeters, 105 millimeters and 118 millimeters along the longitudinal direction L from the mounting surface 11 toward the body opening 12. A diameter of the body opening 12 is 96 millimeters. Each light recess 13 comprises an inclined surface 131 and a bottom surface 132. An angle formed between the inclined surface 131 and the interior of the body 10 is 30 degrees. The bottom surface 132 is connected with a bottom of the inclined surface 131 and is parallel with the mounting surface 11, such that a cross section of the light recess 13 is triangular. An interval between the bottom surface and the mounting surface 11 is 40 millimeters. A maximum height of each light recess 13 is 22 millimeters. A width of each light recess 13 is 20/360 of a perimeter of the interior of the body 10, such that the width of each light recess 13 is 14 millimeters.

The light-emitting diodes 20 are respectively mounted in the light recesses 13. The light-emitting diodes 20 are respectively a red light-emitting diode, a green light-emitting diode, and a blue light-emitting diode. An emitting angle of each light-emitting diode 20 is 30 degrees, such that each light-emitting diode 20 has high directivity. The light-emitting diodes 20 are adjacent to the interior of the body 10. Each light-emitting diode 20 is mounted in the corresponding light recess 13 at a working angle, such that each light-emitting diode 20 can emit light toward the longitudinal direction L.

Figure 5:
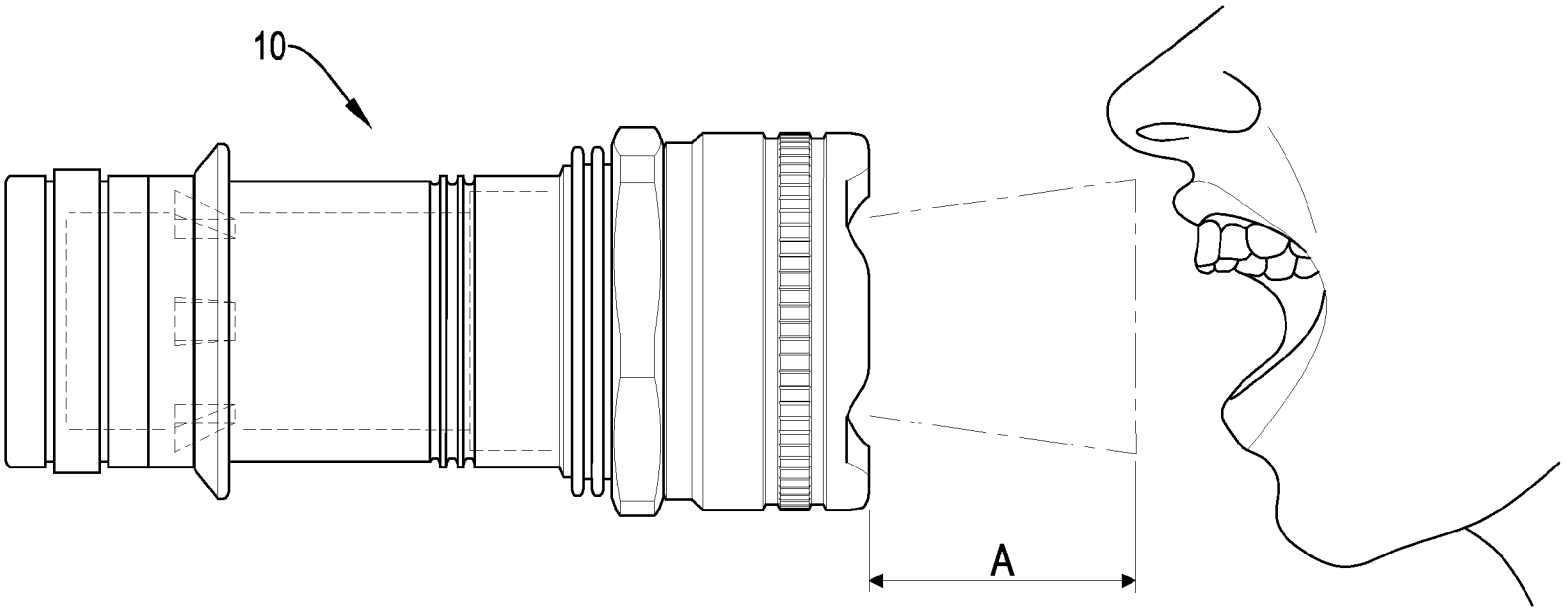
FIGS. 5 and 6 show operational side views of the light-mixing flashlight in FIG. 1.

With reference to FIGS. 3 to 6, the first reflectors 30 are respectively mounted in the light recesses 13. The first reflectors 30 are made of aluminum having relatively high reflectivity, such that during the reflection process of light, energy loss of the light can be decreased. The light emitted from the light-emitting diodes 20 is respectively reflected on the first reflectors 30. Reflectivities of the first reflectors 30 respectively corresponding to the red, the green and the blue light-emitting diodes are respectively 0.9071, 0.9136 and 0.9204. Each first reflector 30 is formed as a parabolic mirror, such that the light emitted from the light-emitting diode 20 can be reflected by the first reflector 30 to form parallel light to be reflected on the second reflector 40. A radius of curvature of each first reflector 30 is 40 millimeters, and a width of an opening of each first reflector 30 is 16 millimeters. An interval between a vertex 31 of each first reflector 30 and the corresponding light-emitting diode 20 is 20 millimeters. The first reflectors 30 are first mounted to be perpendicular to the longitudinal direction L of the body 10, wherein the opening of each first reflector 30 faces toward the corresponding light-emitting diode 20. Then, each first reflector 30 is rotated 19 degrees relative to the longitudinal direction L of the body 10. The working angle of each light-emitting diode 20 is defined by the following: each light-emitting diode 20 is first rotated 30 degrees relative to the longitudinal direction L and then 19 degrees relative to the vertex 31 of the corresponding first reflector 30. Therefore, the light emitted from the light-emitting diodes 20 can be reflected by the first reflectors 30 to emit on the second reflectors 40. The light can be reflected on the second reflectors 40 by the first reflectors 30 accurately to decrease the energy loss of the light.

The second reflectors 40 are mounted on the mounting surface 11 and respectively correspond in position to the first reflectors 30. The second reflectors 40 are made of aluminum having relatively high reflectivity, such that during the reflection process of light, energy loss of the light can be decreased. Each second reflector 40 is formed as a spherical mirror. A radius of curvature of each second reflector 40 is 105 millimeters. Reflectivity of the second reflectors 40 is 0.9204. An interval between a center of each second reflector 40 and a center of the mounting surface 11 is 15.3 millimeters. An interval between the center of each second reflector 40 and the vertex 31 of the corresponding first reflector 30 is 63.5 millimeters. The second reflectors 40 respectively face toward the first reflectors 30 and are rotated 8.17 degrees relative to the longitudinal direction L of the body 10, such that after the light emitted from the light-emitting diodes 20 is reflected by the second reflectors 40, the light can be emitted on a working plane that is distal from the mounting surface 11 by 330 millimeters.

The first reflectors 30 and the second reflectors 40 can increase an emitting efficiency of the light and guide the light in a forward direction, such that the light can be focused on the working plane. Furthermore, illumination of the light within an illuminated area can be mixed uniformly. In use, the light emitted from the light-emitting diodes 20 is first emitted on the first reflectors 30, and then the light is reflected by the first reflectors 30 to be emitted on the second reflectors 40. Then, the light is reflected by the second reflectors 40, and the red light, the green light and the blue light can be mixed to form a white light to project on the working plane that is distal from the mounting surface 11 by 330 millimeters. An interval between the working plane and the body opening 12 is 10 centimeters. The white light provided by the light-mixing flashlight can increase a color contrast of an illuminated object, especially for oral lighting, museum lighting, or diving lighting.

From the above description, it is noted that the present invention has the following advantages: without a diffusion device, the first reflectors 30 and the second reflectors 40 can reflect light, such that the red light, the green light and the blue light can be mixed on the working plane. The emitting efficiency is not affected since no diffusion device is adopted. Therefore, the light-mixing flashlight has improved emitting efficiency.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A light-mixing flashlight comprising:

a body being elongated and hollow, and comprising
- a longitudinal direction;
- a mounting surface formed on a bottom of an interior of the body;
- a body opening formed through an end of the body and located at a position opposite to the mounting surface; and
- three light recesses formed in the interior of the body at intervals;

three light-emitting diodes respectively mounted in the light recesses, wherein the light-emitting diodes are respectively a red light-emitting diode, a green light-emitting diode, and a blue light-emitting diode, and each light-emitting diode is mounted in the corresponding light recess at a working angle;

three first reflectors respectively mounted in the light recesses, formed as parabolic mirrors, each first reflector rotated 19 degrees relative to the longitudinal direction of the body and comprising
- a radius of curvature being 40 millimeters;
- an opening having a width of 16 millimeters, and facing toward the mounting surface of the body; and
- a vertex being distal from the corresponding light-emitting diode by 20 millimeters, wherein the working angle of each light-emitting diode is defined by first rotating each light-emitting diode for 30 degrees relative to the longitudinal direction of the body and then 19 degrees relative to the vertex of the corresponding first reflector; and three second reflectors formed as spherical mirrors, mounted on the mounting surface and respectively corresponding to the first reflectors, each second reflector rotated 8.17 degrees relative to the longitudinal direction of the body and comprising
- a radius of curvature being 105 millimeters; and a center being distal from the vertex of the corresponding first reflector by 63.5 millimeters, and being distal from a center of the mounting surface by 15.3 millimeters.

2. The light-mixing flashlight as claimed in claim 1, wherein the first reflectors are made of aluminum, and reflectivities of the first reflectors respectively corresponding to the red, the green and the blue light-emitting diodes are respectively 0.9071, 0.9136 and 0.9204.

3. The light-mixing flashlight as claimed in claim 1, wherein the second reflectors are made of aluminum, and reflectivity of the second reflectors is 0.9204.

4. The light-mixing flashlight as claimed in claim 2, wherein the second reflectors are made of aluminum, and reflectivity of the second reflectors is 0.9204.

5. The light-mixing flashlight as claimed in claim 3, wherein an emitting angle of each light-emitting diode is 30 degrees.

6. The light-mixing flashlight as claimed in claim 4, wherein an emitting angle of each light-emitting diode is 30 degrees.

7. The light-mixing flashlight as claimed in claim 5, wherein the interior of the body is made of aluminum.

8. The light-mixing flashlight as claimed in claim 6, wherein the interior of the body is made of aluminum.

9. The light-mixing flashlight as claimed in claim 7, wherein a longitudinal length of the body along the longitudinal direction is 230 millimeters, and a diameter of the body opening is 96 millimeters.

10. The light-mixing flashlight as claimed in claim 8, wherein a longitudinal length of the body along the longitudinal direction is 230 millimeters, and a diameter of the body opening is 96 millimeters.

11. The light-mixing flashlight as claimed in claim 9, wherein each light recess comprises an inclined surface, and an angle formed between the inclined surface and the interior of the body being 30 degrees;

a bottom surface connected with a bottom of the inclined surface and being parallel with the mounting surface, wherein an interval between the bottom surface and the mounting surface is 40 millimeters;

a maximum height of the light recess being 22 millimeters; and a width of the light recess being 20/360 of a perimeter of the interior of the body.

12. The light-mixing flashlight as claimed in claim 10, wherein each light recess comprises an inclined surface, and an angle formed between the inclined surface and the interior of the body being 30 degrees;

a bottom surface connected with a bottom of the inclined surface and being parallel with the mounting surface, wherein an interval between the bottom surface and the mounting surface is 40 millimeters;

a maximum height of the light recess being 22 millimeters; and a width of the light recess being 20/360 of a perimeter of the interior of the body.

* * * * *